US008284225B2

(12) United States Patent
Imaizumi

(10) Patent No.: US 8,284,225 B2
(45) Date of Patent: Oct. 9, 2012

(54) PRINTER AND CONTROL METHOD FOR A PRINTER

(75) Inventor: Atsuyuki Imaizumi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 430 days.

(21) Appl. No.: 12/688,620

(22) Filed: Jan. 15, 2010

(65) Prior Publication Data

US 2010/0182390 A1 Jul. 22, 2010

(30) Foreign Application Priority Data

Jan. 19, 2009 (JP) ..... 2009-008486

(51) Int. Cl.
*B41J 2/35* (2006.01)

(52) U.S. Cl. ..... 347/211

(58) Field of Classification Search ..... 347/211, 347/188, 183, 190, 191, 194, 196, 215, 218, 347/171; 400/120.09, 279
See application file for complete search history.

(56) References Cited

U.S. PATENT DOCUMENTS 5,852,369 A * 12/1998 Katsuma ..... 347/211
5,867,200 A * 2/1999 Tajima et al. ..... 347/211
6,320,604 B1 * 11/2001 Moriya et al. ..... 347/211
6,388,691 B1 * 5/2002 Maeyama et al. ..... 347/183
6,496,211 B2 * 12/2002 Katsuma ..... 347/188

FOREIGN PATENT DOCUMENTS

JP 08-034135 A 2/1996
JP 11-277783 A 10/1999
JP 11-286130 A 10/1999
JP 2002-248800 A 9/2002

* cited by examiner

*Primary Examiner* — Kristal Feggins
(74) *Attorney, Agent, or Firm* — Kilpatrick Townsend & Stockton LLP

(57) ABSTRACT

A printer and a control method for a printer can externally detect the number of elements in the line head, and can determine the dot density of the line head from the detected number of elements. The printer has a thermal head 1 having an array of plural elements for forming print dots, a plural stage shift register 3 that shifts the input data according to a clock signal, a latch 2 that temporarily stores the output from each stage (3-1 to **3-*n*) of the shift register 3, a driver 2 that outputs the data held in each latch to the element of the thermal head 1 corresponding to each latch as print data based on a strobe signal, a output terminal 4 that outputs the output data of the last stage of the shift register 3, an element count detection data generating unit 13 that inputs to the shift register 3 input data of which the value corresponding to the first clock pulse is 1 and all following values are 0, and an element number counting unit 12 that detects the number of elements by counting the clock pulses until the data output from the output terminal 4** is 1.

13 Claims, 4 Drawing Sheets

| HEAD TYPE | HEAD ELEMENT DENSITY | HEAD WIDTH | NUMBER OF ELEMENTS |
|---|---|---|---|
| A | 7dot/mm(180dot/inch) | 72mm | 512 |
| B | 8dot/mm(203dot/inch) | 72mm | 576 |
| C | 8dot/mm(203dot/inch) | 80mm | 640 |
| D | 8dot/mm(203dot/inch) | 114mm | 1024 |

PRINTER AND CONTROL METHOD FOR A PRINTER

This application claims priority under 35 U.S.C. §119 to Japanese Patent Application No. 2009-008486 filed on Jan. 19, 2009, the entire disclosure of which are expressly incorporated by reference herein.

BACKGROUND

1. Technical Field

The present invention relates to a printer that prints one dot line at a time using a line head, and to a control method for the printer.

2. Related Art

Printers such as thermal printers that print one dot line at a time using a fixed line head are typically used in POS printers. See, for example, Japanese Unexamined Patent Appl. Pub. JP-A-H08-34135 and Japanese Unexamined Patent Appl. Pub. JP-A-2002-248800.

FIG. 7 is a block diagram showing the configuration of a thermal printer according to the related art. As shown in FIG. 7, the thermal printer has a thermal head (line head) 101 composed of a plurality of heating elements arrayed in a line, a shift register 103 (shift register circuit) composed of n flip-flops, a latch (latch circuit) that temporarily latches the values of the shift register 103, a latch driver 102 composed of latches (latch circuits) that control heating the heating elements and a driver that is a transistor or other drive circuit, and a head control unit 104.

The head control unit 104 sends print data (serial data, input data) for one dot line to the shift register 103 (to the first flip-flop 103-1) synchronized to a clock signal CLK.

When sending the one dot line of print data is completed, the head control unit 104 sends a latch signal LAT to the latch driver 102. As a result, the print data for one dot line is latched in the latch driver 102 (that is, the data is temporarily stored). After one dot line of data is thus set, the head control unit 104 sends a strobe signal STB that defines the energize time of each heating element to the latch driver 102.

The latch driver 102 then energizes each heating element corresponding to a "1" in the latched data based on the strobe signal STB. Each energized heating element changes the color of the thermal paper used as the recording medium, and forms an image of one dot. The paper is then advanced the distance of one line by a paper feed mechanism including a motor and rollers. These steps repeat to sequentially print one line at a time.

The specifications for the number and density of the heating elements on the thermal head used in a thermal printer vary widely according to the application of the customer. This means that the circuit board must be changed according to the specifications of the thermal head, and different firmware is also required. The need for firmware and circuit boards designed and built to different specifications increases the development cost and complicates inventory management.

Furthermore, because the number of heating elements and the density of the heating element array cannot be detected automatically, a DIP switch could conceivably be provided on the circuit board and set according to the specifications of the thermal head. However, in addition to this requiring the operator, for example, to configure the DIP switch, there is also the possibility that the thermal head and DIP switch settings will not correspond correctly after parts are replaced or repaired because the number and the density of the heating elements are not readily apparent from the appearance of the thermal head. Another problem is the increase in the cost of the circuit board resulting from using a DIP switch.

SUMMARY

At least one embodiment of the present invention is directed to solving the foregoing problems, and a printer and a control method for a printer according to the present at least one embodiment of can automatically detect the number of elements on the thermal head.

A first aspect of the invention is a printer having a line head having an array of plural elements; a shift register circuit that shifts input data input from an input terminal according to a clock signal; a latch circuit that temporarily stores the input data of the shift register according to a latch signal; a driver that outputs the input data held by the latch circuit to the elements of the line head according to a strobe signal; an output terminal that outputs output data from the shift register circuit according to the clock signal; a head control unit that outputs the clock signal, the input data, the strobe signal, and the latch signal; an element count detection data generating unit that generates element count detection data for detecting the number of elements in the line head, and outputs to the input terminal of the shift register circuit synchronized to the clock signal output by the head control unit; and an element number counting unit detects the number of elements in the line head based on output of the element count detection data input to the shift register circuit from the output terminal.

Preferably, the element count detection data generating unit generates the element count detection data so that the first value, which corresponds to the first clock pulse of the clock signal, is 1 or 0, and all following values are the opposite of the first value; and the element number counting unit detects the number of elements by counting the number of clock pulses in the clock signal until said first value is detected in the output data output from the output terminal.

This aspect of the invention can automatically detect the number of elements in the line head. Based on the number of elements, the line head settings in the firmware of the printer can therefore automatically be changed and controlled. Providing a DIP switch on the circuit board is therefore not necessary, and the manufacturing cost can be reduced. In addition, the operator does not need to configure settings, and the wrong combination of thermal head and DIP switch settings will not result from a repair or parts replacement. Furthermore, because a common circuit board and common firmware can be used, there is no need to manufacture plural different circuit boards and corresponding firmware, and the firmware development cost can be reduced and inventory management simplified.

Further preferably, the printer also has a storage unit that stores an element array density corresponding to the number of elements, and an element density detection unit that refers to the storage unit and determines the array density of the elements from the number of elements detected by the element number counting unit.

This aspect of the invention can detect the number of elements in the line head, and based on the detected number of elements can determine the dot density of the element array. Line head settings can therefore be automatically changed and controlled based on the detected number of elements and the dot density.

Further preferably, the line head is a thermal head. This aspect of the invention is suitable for thermal printers used to print receipts meeting a diverse range of customer needs.

Yet further preferably, the printer also has a control unit that determines printing conditions based on the number of elements. This aspect of the invention is suitable for thermal printers used to print receipts using a wide range of paper widths meeting different customer needs. The printing conditions can include at least one of the printing speed, printing element drive time, printing area, number of print columns, and font type.

Yet further preferably, the printer also has a paper feed mechanism, and a control unit that determines the paper feed pitch of the paper feed mechanism based on the number of elements. This aspect of the invention can also appropriately control the length of the printed dots in the paper feed direction when the dot density of the element array changes.

Another aspect of the invention is a control method for a printer that has a line head having an array of plural elements, a shift register circuit that shifts input data input from an input terminal according to a clock signal, a latch circuit that temporarily stores the input data of the shift register circuit according to a latch signal, a driver that outputs the input data held by the latch circuit to the elements of the line head according to a strobe signal, an output terminal that outputs output data from the shift register circuit according to the clock signal, and a head control unit that outputs the clock signal, the input data, the strobe signal, and the latch signal, the control method having steps of: an element count detection data generating unit generating element count detection data for detecting the number of elements in the line head, and outputting to the shift register circuit synchronized to the clock signal output by the head control unit; and an element number counting unit detecting the number of elements based on output of the element count detection data input to the shift register circuit from the output terminal.

Preferably, the element count detection data is generated so that the first value, which corresponds to the first clock pulse of the clock signal, is 1 or 0, and all following values are the opposite of the first value, and the number of elements is detected by counting the number of clock pulses in the clock signal until said first value is detected in the output data output from the output terminal.

With the printer control method according to this aspect of the invention, the number of elements in the line head can be automatically detected. Based on the number of elements, the line head settings in the firmware of the printer can therefore automatically be changed and controlled. Providing a DIP switch on the circuit board is therefore not necessary, and the manufacturing cost can be reduced. In addition, the operator does not need to configure settings, and the wrong combination of thermal head and DIP switch settings will not result from a repair or parts replacement. Furthermore, because a common circuit board and common firmware can be used, there is no need to manufacture plural different circuit boards and other types of firmware, and the firmware development cost can be reduced and inventory management simplified.

A control method for a printer according to another aspect of the invention also has a storage unit that stores an array density of the elements corresponding to the number of elements; and an element density detection unit that refers to the storage unit based on the detected number of elements and determines the array density.

The printer control method according to this aspect of the invention can detect the number of elements in the line head, and based on the detected number of elements can determine the dot density of the element array. Line head settings can therefore be automatically changed and controlled based on the detected number of elements and the dot density.

A control method for a printer according to another aspect of the invention changes line head settings based on the detected number of elements.

Various printing control settings can be changed and controlled based on the detected number of elements and printing element array density using common firmware written for plural different number of elements and element array densities.

In a control method for a printer according to another aspect of the invention the line head is a thermal head. This aspect of the invention is suitable for thermal printers used to print receipts meeting a diverse range of customer needs.

A control method for a printer according to another aspect of the invention also has a control unit that determines printing conditions based on the number of elements. This aspect of the invention is suitable for thermal printers used to print receipts using a wide range of paper widths meeting different customer needs. The printing conditions can include at least one of the printing speed, printing element drive time, printing area, number of print columns, and font type.

A control method for a printer according to another aspect of the invention also has a paper feed mechanism, and a control unit that determines the paper feed pitch of the paper feed mechanism based on the number of elements. This aspect of the invention can also appropriately control the length of the printed dots in the paper feed direction when the dot density of the element array changes.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer and a control method for a printer according to the invention are described below with reference to the accompanying figures.

Figure 1:
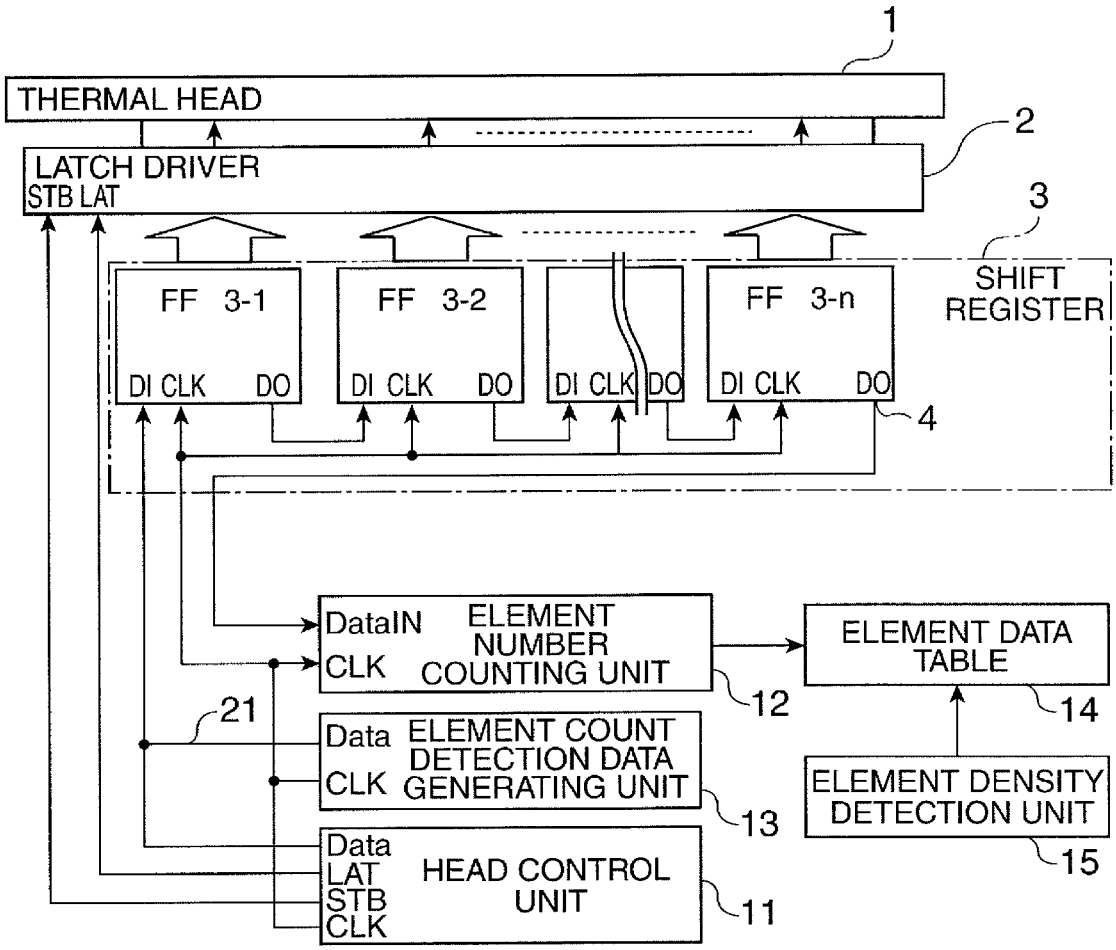
FIG. 1 is a block diagram showing the configuration of a thermal printer according to a preferred embodiment of the invention.

FIG. 1 is a block diagram showing the configuration of a thermal printer as an example of a printer according to a preferred embodiment of the invention.

The thermal printer according to this embodiment of the invention has a thermal head 1 (line head), a latch (latch circuit) driver (transistor or other drive circuit) 2, a shift register 3 (shift register circuit) composed of n flip-flops (flip-flop circuits), an output terminal 4 of the last flip-flop of the shift register, a head control unit 11, an element number counting unit 12, an element count detection data generating unit 13, an element data table 14, and an element density detection unit 15.

The element number counting unit 12 detects the number of elements in the thermal head 1 by means of the number of elements counting operation described below.

The element count detection data generating unit 13 generates the data that is output when the number of elements is detected.

The element data table 14 is a data table that is referenced to determine the array density of the elements, which corresponds uniquely to the detected number of elements. More specifically, the element data table 14 is a storage unit that stores the density of the element array corresponding to the number of elements.

The element density detection unit 15 determines the density of the element array of the thermal head 1 based on the result of referencing the element data table 14.

The head control unit 11 outputs a clock signal CLK and the print data (serial data, input data) for one dot line to input terminal DI synchronized to the clock signal CLK.

When sending the one dot line of print data is completed, the head control unit 11 sends a latch signal LAT to the latch driver 2. As a result, the print data for one dot line is latched by the latch circuits in the latch driver 2 (that is, the data is temporarily stored). When one dot line of data is thus temporarily stored, the head control unit 11 sends a strobe signal STB to the latch driver 2.

The driver in the latch driver 2 then energizes each heating element of the thermal head 1 corresponding to a "1" in the latched print data based on the strobe signal STB. Each energized heating element changes the color of the thermal paper, the paper is advanced the distance of one line by a paper feed mechanism including a motor and rollers, and a line image one dot wide is formed. These steps repeat to sequentially print an image one line at a time.

The operation whereby the number of elements in the thermal head is detected in the foregoing thermal printer is described next.

Figure 2:
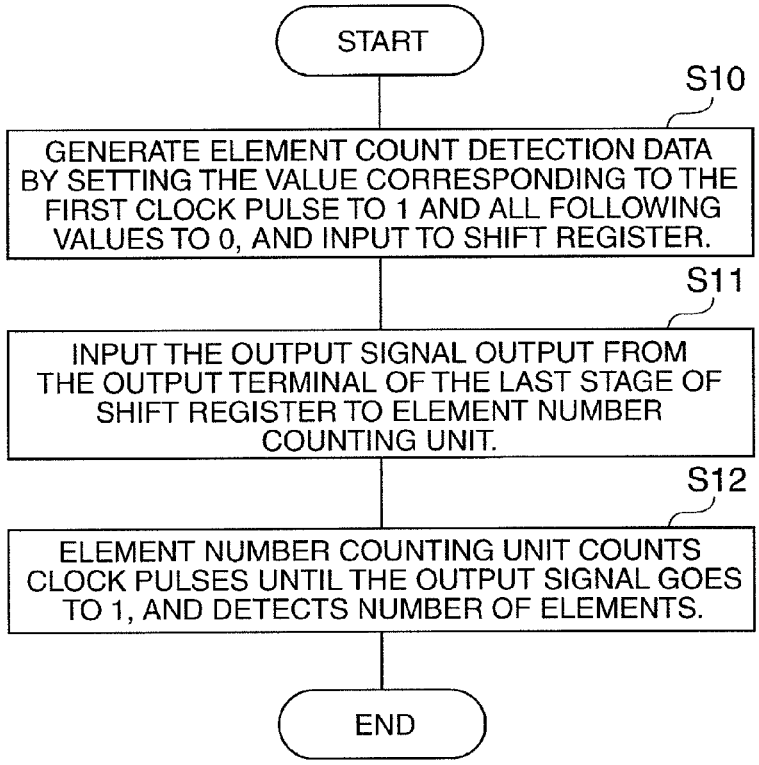
FIG. 2 is a flow chart of an element count detection process for detecting the number of elements on the thermal head of the thermal printer according to the preferred embodiment of the invention.

FIG. 2 is a flow chart describing the element count detection process for detecting the number of elements in the thermal head of the thermal printer according to this embodiment of the invention.

The element count detection data generating unit 13 first inputs the element count detection data 21 from the Data terminal thereof to the input terminal DI (of the first flip-flop 3-1) of the shift register 3 synchronized to the clock signal CLK from the head control unit 11 (step S10).

Figure 3:
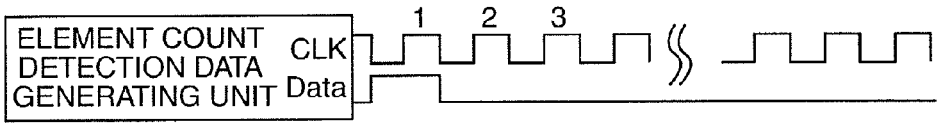
FIG. 3 is a timing chart of the element count detection data output by an element count detection data generating unit.

FIG. 3 is a timing chart of the element count detection data 21 output by the element count detection data generating unit 13. As shown in FIG. 3, the element count detection data 21 is generated and output with the value corresponding to the first clock pulse a "1" and the value corresponding to each following clock pulse a "0." All values before the first clock pulse are also 0.

The output signal output from the output terminal 4 (D0) of the last flip-flop in the shift register is then input synchronized to the clock signal CLK from the head control unit 11 to the input terminal (DataIN) of the element number counting unit 12 (step S11).

Because the shift register 3 has the same number of flip-flops as the number of elements in the thermal head 1 in a cascade, the number of elements can be detected by reading the output signal from the output terminal 4 of the last flip-flop in the shift register in the element number counting unit 12.

Figure 4:
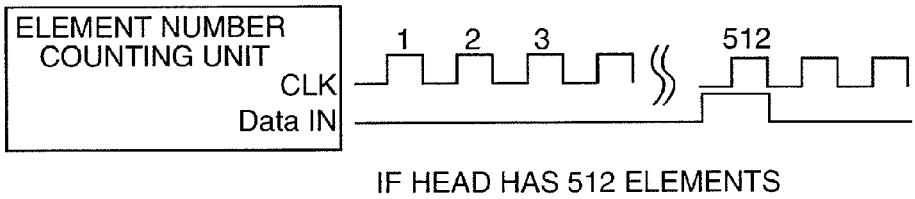
FIG. 4 is a timing chart of the output signal that is input to an element number counting unit from the output terminal at the last stage of a shift register.

FIG. 4 is a timing chart of the input signal input to the element number counting unit 12, that is, the output signal from the output terminal 4 (D0) of the last flip-flop in the shift register.

As shown in the figure, if the number of elements is 512, for example, the value of the 512th clock pulse in the clock signal CLK from the head control unit 11 will be a 1, and will be output from the output terminal 4 (D0) to the data input terminal (DataIN) of the element number counting unit 12. The element number counting unit 12 can therefore detect the number of elements by counting the number of clock pulses (CLK) until a 1 is detected (step S12).

The number of elements in the thermal head can therefore be detected by outputting the element count detection data 21 and detecting the output signal from the output terminal 4 of the last flip-flop 3-*n* in the shift register.

The operation whereby the array density of the elements in the thermal head is detected in the thermal printer according to this embodiment of the invention is described next.

Figure 5:
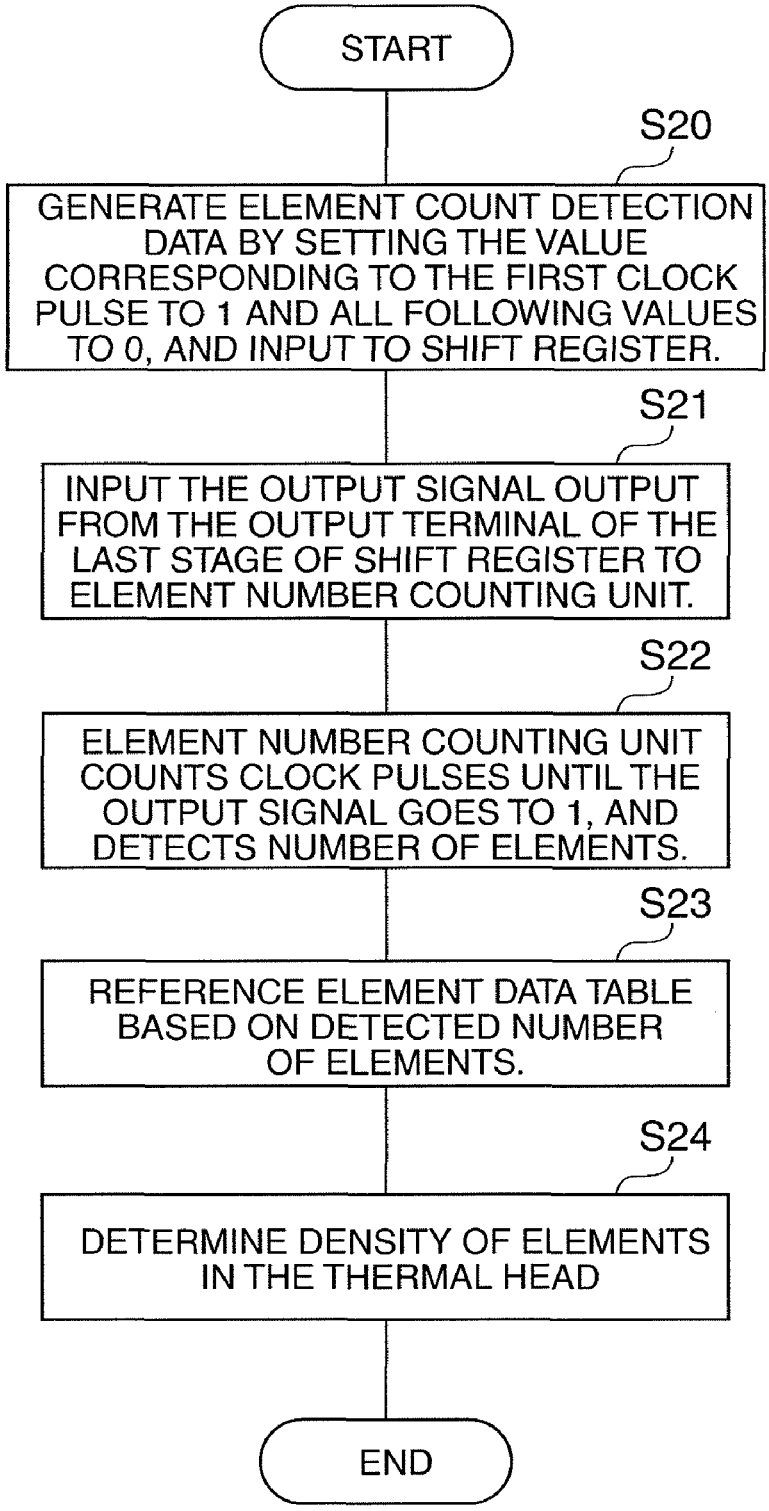
FIG. 5 is a flow chart of an element density detection process for detecting the density of the elements arrayed in the thermal head of a thermal printer according to a preferred embodiment of the invention.
Figures 6, 7:
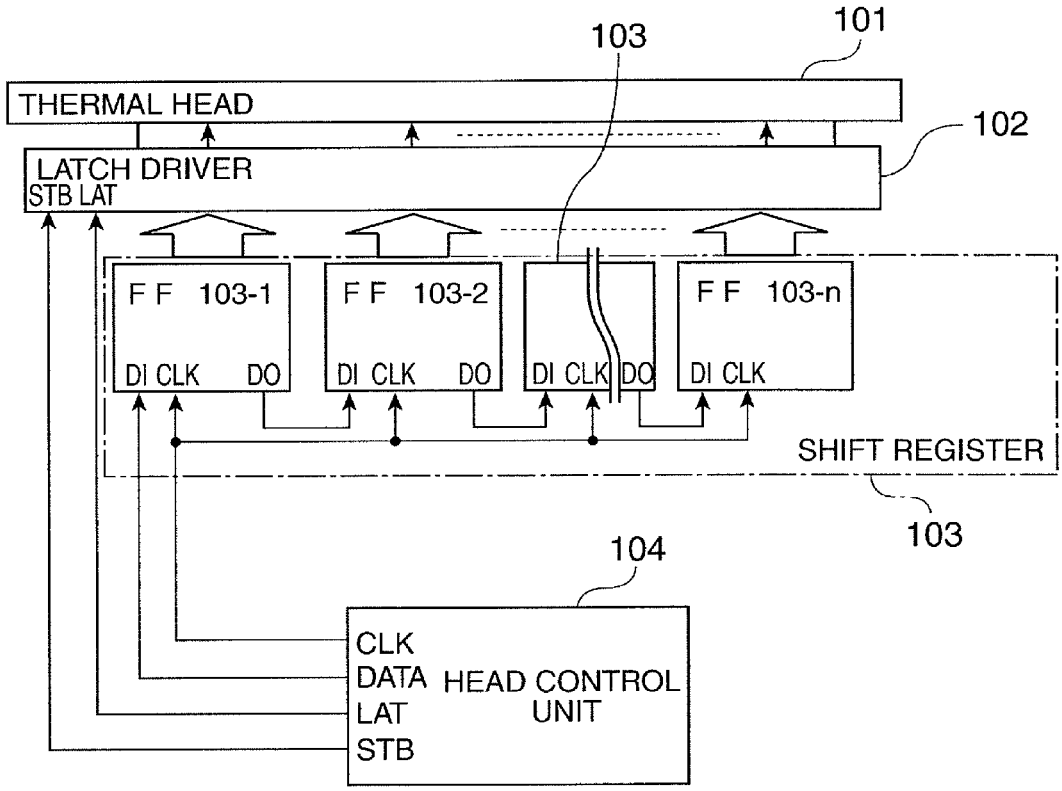
FIG. 6 shows an example of the data structure of an element data table.
FIG. 7 is a block diagram showing the configuration of a thermal printer according to the related art.

FIG. 5 is a flow chart of an element density detection process for detecting the density of the elements arrayed in the thermal head of a thermal printer according to a preferred embodiment of the invention. FIG. 6 shows an example of the data structure of the element data table 14.

After the number of elements in the thermal head 1 is first detected using the same process described in steps S10 to S12 in the flow chart shown in FIG. 2 (step S20 to step S22), the element density detection unit 15 references the element data table 14 based on the detected number of elements (step S23).

The type of the thermal head can be uniquely detected from the detected number of elements. For example, in the example shown in FIG. 6, if the detected number of elements is 512, the type of the thermal head is known to be A, the head element density is therefore known to be 7 dot/mm (180 dot/inch), and the head width (printing area) is known to be 72 mm. More specifically, because the density of the head elements is defined for each type of thermal head in the element data table 14, the element density detection unit 15 can determine the array density of the elements in the thermal head from the element data table 14.

A thermal printer according to this embodiment of the invention can thus detect the number of elements in the thermal head, and can also determine the density of the elements arrayed in the thermal head corresponding to the detected number of elements. Note that the thermal head element count detection process and element density detection process may be executed when a thermal head is installed during a repair and the thermal printer power is then turned on or the printer is initialized, for example.

Firmware that differs according to the type of head is required in a thermal printer according to the related art because various settings related to printer control, such as the printing speed, strobe signal, the energize time of the thermal head, and the paper feed pitch, in a thermal printer change according to the number and density of the elements in the thermal head.

However, because the thermal printer according to this embodiment of the invention can automatically detect the number of elements and the density of the element array in the thermal head by detecting the number of elements in the thermal head and detecting the density of the element array when the thermal printer is initialized, for example, if the firmware is written to be compatible with plural thermal heads having different numbers of elements and array densities, the printing control settings can be changed and printing can be controlled based on the detected number of elements and the element density.

For example, in a thermal head with an element array density of 7 dot/mm (180 dot/inch), the print dot interval and the paper feed pitch are 0.141 mm. If the thermal head has an element density of 8 dot/mm (203 dot/inch), the print dot interval and the paper feed pitch are 0.125 mm.

If the printing area of images printed on the recording medium (printing paper) is the same size, more time is required for data processing and data transfer with a thermal head having an element density of 8 dot/mm (203 dot/inch) because there is more data (the number of elements is greater).

As the printing speed increases, the effect of these times increases. If paper feed (printing speed) is constant, the paper is conveyed 0.141 mm to print data for one dot line if the element density of the thermal head is 7 dot/mm (180 dot/inch), but the paper is conveyed 0.125 mm if the element density of the thermal head is 8 dot/mm (203 dot/inch).

There is thus a correlation between the density of the elements in the thermal head and the printing speed. In addition, when the density of the heating elements of the thermal head differs, the size of the heating elements typically changes (in this example the elements in the thermal head with a heating element density of 203 dpi are smaller), and the energize time required to heat the elements to the same temperature is shorter in a thermal head with a heating element density of 8 dot/mm (203 dot/inch) than in a thermal head with a heating element density of 7 dot/mm (180 dot/inch).

An example of changing various settings (printing conditions) related to printing control based on the number of elements and the element density detected in this embodiment of the invention is described next.

When element density differs according to head width

The element density of the thermal printer in this example is initially set to 7 dot/mm. When the printer is then initialized, the element array density is determined by applying the element density detection process according to the preferred embodiment shown in FIG. 5 to the thermal head of the thermal printer.

If the element density is thus determined to be 8 dot/mm and printing proceeds using the same font, the size of the printed characters will change because the element density is set to 7 dot/mm and the characters are therefore printed smaller because of the higher dot density. If plural font types are available in this situation, a wider font can be selected so that the number of columns printed is the same as for a print head with a printing element density of 7 dot/mm. Alternatively, if the same font is used and 47 columns can be printed using an 8 dot/mm print head, only 42 columns are printed.

As a result, when a thermal head with a different dot density is used, print content from a host computer can be printed with the same character size or column width using common firmware.

In addition, when the dot density changes, the paper feed pitch must also be changed. If the thermal head is changed from a 180 dpi array to a head with a different density (such as a 8 dot/mm), the paper feed pitch can be changed by changing gears if plural gears with different tooth counts are available. The paper feed pitch can also be changed from 0.141 mm to 0.125 mm, for example, by changing the paper feed pitch through motor control, such as by changing the number of steps a stepping motor is driven to advance the paper one dot line.

When the element density is the same but the number of elements is different

As shown in FIG. 6, if the thermal printer is set up for a print head of type C (the column width of the printing area is 53 characters) and the print head is then changed to type B (printing 48 characters wide using the same characters), data for 5 characters will overflow from the shift register 3 and cannot be printed if the setting is not changed.

Because the thermal printer according to this embodiment of the invention automatically detects the number of elements, the bit count of the transferred data can be controlled according to the detected number of elements even if a thermal head with a different number of elements is installed. In this example, therefore, character data for only 48 columns is sent to the shift register 3, and the data is sequentially shifted so that the remaining characters are carried to the next line. The data can therefore be printed without characters overflowing and being lost.

Conversely, if the head type changes from B to C, spaces (white space) can be inserted to fill the missing character data on each line so that the resulting blank space on one line is not filled by data from the next line, and each line can be printed on a different line.

A thermal printer and a control method for a thermal printer according to this embodiment of the invention can thus automatically detect the number of elements in the thermal head and optimize settings accordingly.

Settings can thus be appropriately changed and controlled automatically even using common firmware based on the detected number of elements and dot density. There is therefore no need to provide a DIP switch, and the manufacturing cost can be reduced. In addition, the operator does not need to configure settings, and the wrong combination of thermal head and DIP switch settings will not result from a repair or parts replacement. Furthermore, because a common circuit board and common firmware can be used, there is no need to manufacture plural different circuit boards and corresponding firmware, and the firmware development cost can be reduced and inventory management simplified. Printing conditions can also be determined based on the detected number of elements.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a line head having an array of plural elements;

a shift register circuit that shifts input data input from an input terminal according to a clock signal;

a latch circuit that temporarily stores the input data of the shift register circuit according to a latch signal;

a driver that outputs the input data held by the latch circuit to the elements of the line head according to a strobe signal;

an output terminal that outputs output data from the shift register circuit according to the clock signal;

a head control unit that outputs the clock signal, the input data, the strobe signal, and the latch signal;

an element count detection data generating unit that generates element count detection data for detecting the number of elements in the line head, and outputs to the input terminal of the shift register circuit synchronized to the clock signal output by the head control unit; and an element number counting unit detects the number of elements in the line head based on the element count detection data outputted from the output terminal.

2. The printer described in claim 1, wherein:

the element count detection data generating unit generates the element count detection data so that the first value, which corresponds to the first clock pulse of the clock signal, is 1 or 0, and all following values are the opposite of the first value; and the element number counting unit detects the number of elements by counting the number of clock pulses in the clock signal until said first value is detected in the output data output from the output terminal.

3. The printer described in claim 1, further comprising:

a storage unit that stores an array density of the elements corresponding to the number of elements; and an element density detection unit that refers to the storage unit and determines the array density of the elements from the number of elements detected by the element number counting unit.

4. The printer described in claim 1, wherein:

the line head is a thermal head.

5. The printer described in claim 1, further comprising:

a control unit that determines printing conditions based on the detected number of elements.

6. The printer described in claim 1, further comprising:

a paper feed mechanism; and a control unit that determines the paper feed pitch of the paper feed mechanism based on the number of elements.

7. A control method for a printer that has a line head having an array of plural elements, a shift register circuit that shifts input data input from an input terminal according to a clock signal, a latch circuit that temporarily stores the input data of the shift register circuit according to a latch signal, a driver that outputs the input data held by the latch circuit to the elements of the line head according to a strobe signal, an output terminal that outputs output data from the shift register circuit according to the clock signal, and a head control unit that outputs the clock signal, the input data, the strobe signal, and the latch signal, the control method comprising steps of:

an element count detection data generating unit generating element count detection data for detecting the number of elements in the line head, and outputting to the shift register circuit synchronized to the clock signal output by the head control unit; and an element number counting unit detecting the number of elements based on the element count detection data outputted from the output terminal.

8. The control method for a printer described in claim 7, wherein:

the element count detection data is generated so that the first value, which corresponds to the first clock pulse of the clock signal, is 1 or 0, and all following values are the opposite of the first value; and the number of elements is detected by counting the number of clock pulses in the clock signal until said first value is detected in the output data output from the output terminal.

9. The control method for a printer described in claim 7, further comprising:

a storage unit that stores an array density of the elements corresponding to the number of elements; and an element density detection unit that refers to the storage unit based on the detected number of elements and determines the array density.

10. The control method for a printer described in claim 7, further comprising a step of:

changing the line head settings based on the detected number of elements.

11. The control method for a printer described in claim 7, wherein:

the line head is a thermal head.

12. The control method for a printer described in claim 7, further comprising:

a control unit that determines printing conditions based on the number of elements.

13. The control method for a printer described in claim 7, further comprising:

a paper feed mechanism; and a control unit that determines the paper feed pitch of the paper feed mechanism based on the number of elements.

* * * * *